US006124768A

United States Patent [19]

Makiyama

[11] Patent Number: 6,124,768

[45] Date of Patent: Sep. 26, 2000

[54] MICROWAVE TESTING HIGH-POWER DUMMY LOAD FORMING METHOD AND MICROWAVE TESTING HIGH-POWER DUMMY LOAD APPARATUS

[75] Inventor: Joji Makiyama, Tokyo, Japan

[73] Assignee: NEC Corporation, Tokyo, Japan

[21] Appl. No.: 09/189,238

[22] Filed: Nov. 10, 1998

[30] Foreign Application Priority Data

Nov. 11, 1997 [JP] Japan ..... 9-308785

[51] Int. Cl.[7] ..... H01P 1/26; H01P 5/12

[52] U.S. Cl. ..... 333/127; 333/22 R

[58] Field of Search ..... 333/127, 128, 333/22 R

[56] References Cited

U.S. PATENT DOCUMENTS

| | | | |
|---|---|---|---|
| 2,428,831 | 10/1947 | Brown et al. | 333/127 |
| 2,524,183 | 10/1950 | Wheeler | 333/22 R |
| 4,024,478 | 5/1977 | Wolfe | 333/22 R |
| 4,577,167 | 3/1986 | Evans | 333/128 |

FOREIGN PATENT DOCUMENTS

| | | |
|---|---|---|
| 2842255 | 4/1980 | Germany . |
| 3013666 | 11/1980 | Germany . |
| 19503245 | 8/1996 | Germany . |
| 56-103501 | 8/1981 | Japan . |
| 58-51494 | 3/1983 | Japan . |
| 61-93004 | 6/1986 | Japan . |
| 61-147601 | 7/1986 | Japan . |
| 2-193401 | 7/1990 | Japan . |
| 3-28808 | 3/1991 | Japan . |
| 3-128309 | 12/1991 | Japan . |
| 4-23307 | 2/1992 | Japan . |
| 4-33114 | 3/1992 | Japan . |
| 4-80107 | 7/1992 | Japan . |
| 4-245804 | 9/1992 | Japan . |
| 9-139608 | 5/1997 | Japan . |

OTHER PUBLICATIONS

German Office Action received Nov. 18, 1999 in a related application and an English translation of the same.

*Primary Examiner*—Paul Gensler
*Attorney, Agent, or Firm*—Ostrolenk, Faber, Gerb, & Soffen, LLP

[57] ABSTRACT

In a method for forming microwave testing high-power dummy load, a first center conductor, to which microwave power is input, is connected to a power distributor formed from a second center conductor having an output-side distal end branching into a plurality of portions. This causes the microwave power input to the first center conductor to separate into a plurality of outputs in correspondence with the output-side distal end of the second center conductor. A plurality of termination resistors are connected between the output-side distal end of the second center conductor and a ground conductor to make the termination resistors consume the microwave power. The heat generated by the termination resistors upon consumption of the microwave power is radiated by the ground conductor. A microwave testing high-power dummy load apparatus made by the above described method is also disclosed.

10 Claims, 5 Drawing Sheets

MICROWAVE TESTING HIGH-POWER DUMMY LOAD FORMING METHOD AND MICROWAVE TESTING HIGH-POWER DUMMY LOAD APPARATUS

BACKGROUND OF THE INVENTION

The present invention relates a microwave testing dummy load method and apparatus.

A conventional dummy load of this type having a large capacity of 1 kW or more requires a large resistive element. For this reason, an oil- or water-cooled dummy load is used where a metal film is deposited on the surface of a porcelain member, and the member is dipped in an insulating oil or water. However, this dummy load is expensive and hence is not practical.

A dry dummy load, which can be manufactured at a low cost and demands no maintenance, has a structure in which microwave power is input from an input external conductor 5 to a resistive element 14*e* on a dielectric substrate 11, as shown in FIGS. 4A and 4B. The resistive element 14*e* is formed by depositing a metal film such as a carbonyl iron powder or graphite film on the surface of an insulator with a low thermal resistance, e.g., beryllia or alumina. Reference numeral 13 denotes a ground conductor.

A dummy load apparatus is disclosed in Japanese Patent Laid-Open No. 61-147601 (JP '601) as an apparatus in which input microwave power is distributed to a plurality of termination resistors to reduce the load on each termination resistor.

In the dummy load apparatus disclosed in (JP '601), hybrid circuits 15, 16, and 17 including phase adjusting resistors 15R, 16R and 17R respectively, are formed on a dielectric substrate 11, and the hybrid circuits 15 and 16 and the hybrid circuits 15 and 17 are connected to each other through resistive center conductors 12*a* and 12*b*, respectively, as shown in FIGS. 5A and 5B. Output center conductors 12*e* and 12*f* of the hybrid circuit 16 are connected to termination resistors 14*c* and 14*d*. Output center conductors 12*c* and 12*d* of the hybrid circuit 17 are connected to termination resistors 14*a* and 14*b*. The termination resistors 14*a* to 14*d* are connected to a common ground conductor 13.

For example, a dummy load of 3W can therefore be formed by setting the rated power of each of the termination loads 14*a* to 14*d* to $$3W \times \tfrac{1}{4} = 750 \text{ mW}$$

In addition, if the termination resistors are flat resistors, the allowable power per unit area is a maximum of 30 mW/mm. The area of one termination resistor is therefore given by $$750 \div 30 = 25 \text{ mm}^2$$

In the former dry dummy load apparatus described above, a beryllia porcelain member having a very low thermal resistance is mainly used as a porcelain member on which a resistive film is formed. However, a beryllia porcelain member is expensive, requires a resistive film having a large area in proportion to the allowable power, and suffers a deterioration in impedance characteristics because an increase in area leads to an increase in stray capacitance. Owing to these problems, as a dummy load apparatus of this type, an apparatus having a power capacity of about 500 W at most can be commercially available at present in consideration of limitations associated with manufacturing techniques, price, temperature rise, and the like. Even if a heat radiation plate is directly mounted on this porcelain member , only a dummy load apparatus having a power capacity of about 1 kW at most can be used in practice.

In the latter dummy load apparatus designed to distribute power to a plurality of termination resistors, the center conductors 12 and 12*a* to 12*f* are formed as thin films on the dielectric substrate 11, as shown in FIG. 5B. Since this structure is formed without any consideration of a temperature rise, only a power capacity of several watts can be obtained.

SUMMARY OF THE INVENTION

It is an object of the present invention to provide a microwave testing high-power dummy load forming method and a microwave testing high-power dummy load apparatus, in which the dummy load has impedance characteristics that allow its use in a broad band.

It is another object of the present invention to provide a microwave testing high-power dummy load forming method and a microwave testing high-power dummy load apparatus, in which the dummy load can have a power capacity of several kW.

In order to achieve the above objects, according to the present invention, there is provided a microwave testing high-power dummy load forming method comprising the steps of connecting a first center conductor, to which microwave power is input, to a power distributor formed from a second center conductor having an output-side distal end branching into a plurality of portions, thereby separating the microwave power input to the first center conductor into a plurality of outputs in correspondence with the output-side distal end of the second center conductor, connecting a plurality of termination resistors between the output-side distal end of the second center conductor and a ground conductor to make the termination resistors consume the microwave power, and radiating heat generated by the termination resistors upon consumption of the microwave power.

DESCRIPTION OF THE PREFERRED EMBODIMENT

The present invention will be described in detail below with reference to the accompanying drawings.

Figure 1:
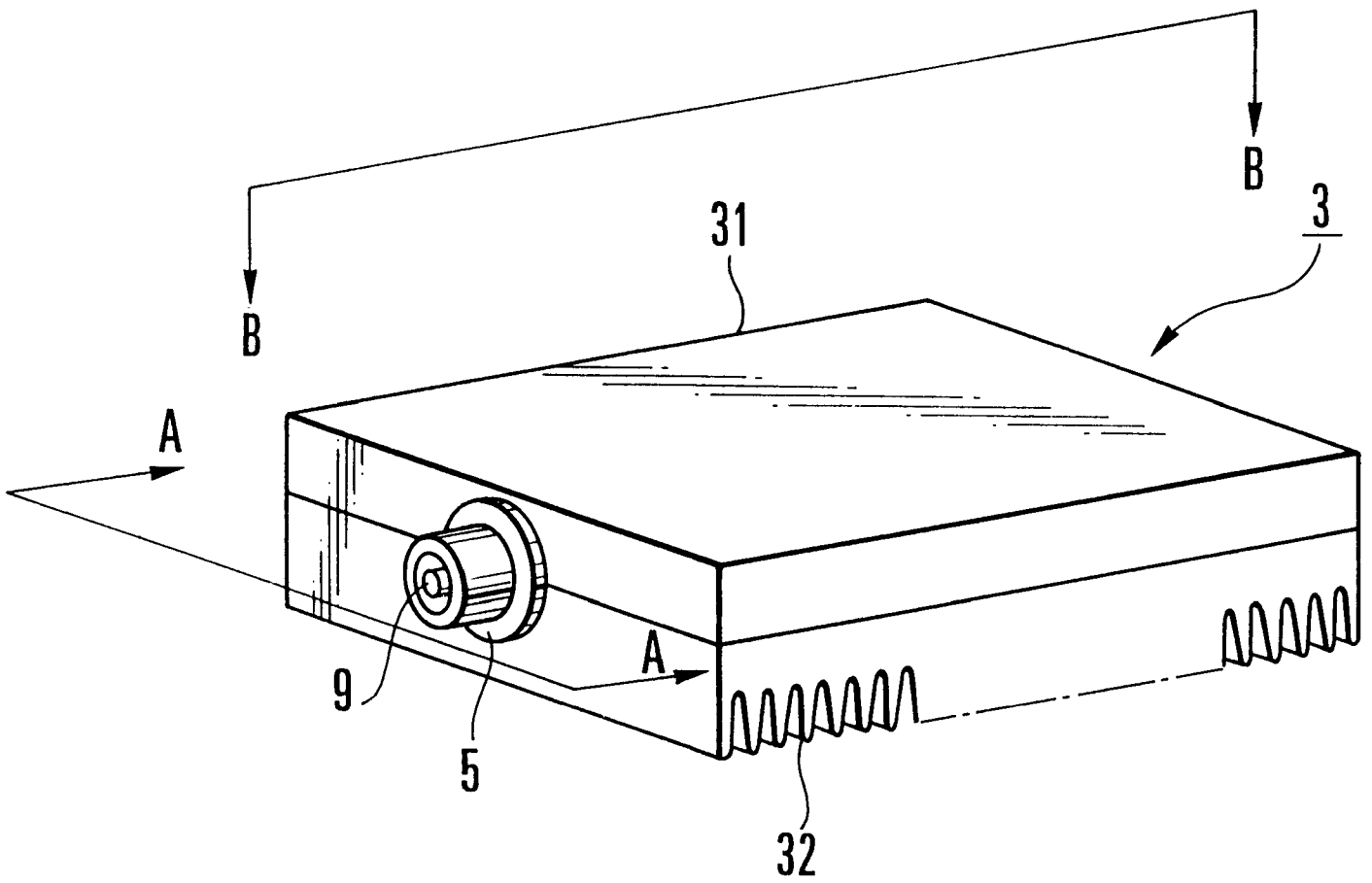
FIG. 1 is a perspective view showing a microwave testing high-power dummy load apparatus according to an embodiment of the present invention.

FIG. 1 shows a microwave testing high-power dummy load apparatus according to an embodiment of the present invention. The high-power dummy load apparatus shown in FIG. 1 is used to test TV and FM broadcasting transmitters.

In the high-power dummy load apparatus in FIG. 1, a ground conductor upper cover 31 and a ground conductor radiator 32 are fastened together with screws to form a ground conductor housing 3 having an internal space. An input external conductor 5 in the form of a stepped sleeve is mounted on a side surface of the ground conductor housing 3.

Figure 2A:
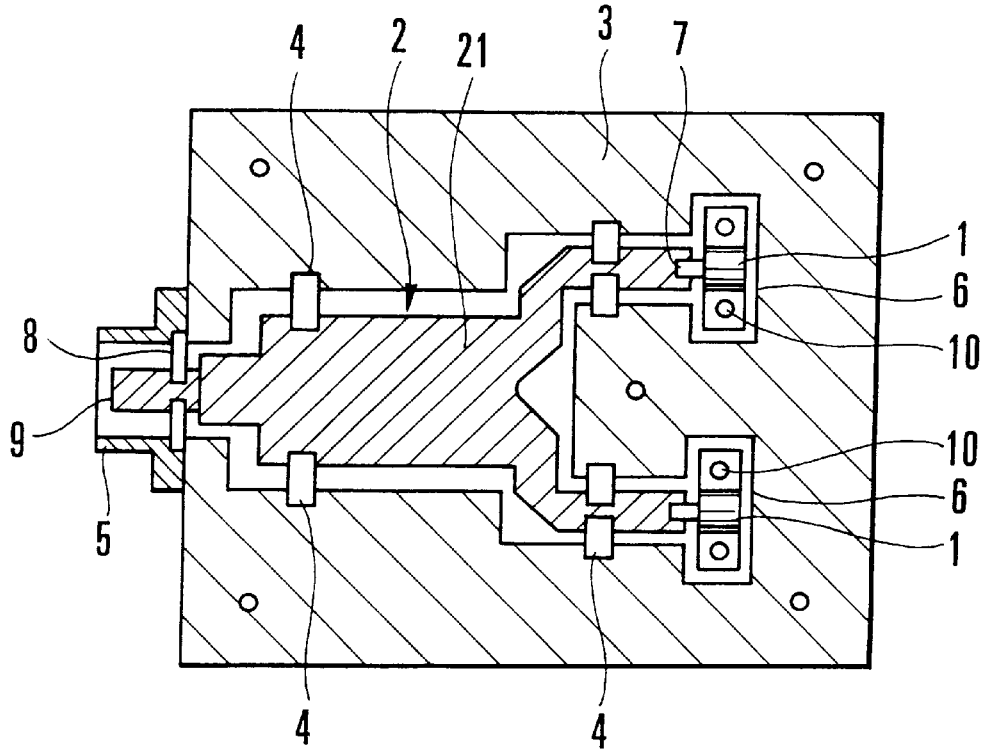
FIG. 2A is a cross-sectional view taken along a line A—A in FIG. 1.

As shown in FIG. 2A, a cylindrical input center conductor 9 is placed in the center of the input external conductor 5. The input center conductor 9 is connected to an impedance transformer type power distributor 2 placed in the internal space of the housing 3. The power distributor 2 is formed from a flat center conductor 21 having a forked distal end portion.

Figure 2B:
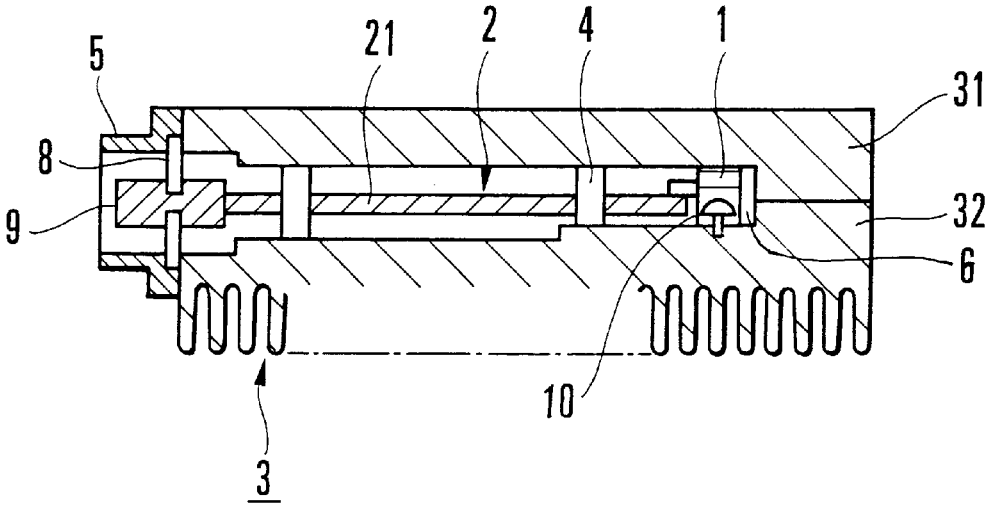
FIG. 2B is a longitudinal sectional view taken along a line B—B in FIG. 1.

As shown in FIG. 2B, the flat center conductor 21 is fixed to the ground conductor housing 3 with insulators 4. Termination resistors 1 are fixed to the ground conductor radiator 32 with metal mount plates 6 and screws 10 at positions near the forked distal end portion of the flat center conductor 21. The termination resistors 1 are connected to the forked distal end portion of the flat center conductor 21 of the power distributor 2 through lead terminals 7.

The input center conductor 9 is fixed to the center of the input external conductor 5 with an insulator 8. The input external conductor 5 and the input center conductor 9 serve as a connector for an external transmission line. Although the insulators 4 and 8 are made of beryllia, they may be made of a ceramic material such as alumina. The ground conductor radiator 32 has a heat radiation structure with a lower surface having a comb-like cross-section.

In the high-power dummy load apparatus having the above structure, microwave power input from the input center conductor 9 is separated into two outputs by the power distributor 2, and the respective outputs are consumed by the two termination resistors 1. Since the power distributor 2 is formed from the flat center conductor 21 having a thickness of several mm, the loss incurred is much smaller than that incurred in a power distributor formed from a thin metal film. This allows high-power distribution.

Although power is consumed by the termination resistors 1, the heat generated by the termination resistors 1 is conducted to the ground conductor radiator 32 through the metal mount plates 6 and the ground conductor upper cover 31 to be radiated. As a result, a temperature rise caused by the heat generated by the termination resistors can be suppressed low.

According to the high-power dummy load apparatus of this embodiment, input microwave power is separated into a plurality of outputs, and the respective outputs are consumed by the termination resistors. In addition, the heat generated upon consumption of power is radiated through the ground conductors. Therefore, a microwave testing dummy load apparatus with a large power of several kW can be realized by using existing termination resistors.

Figure 3:
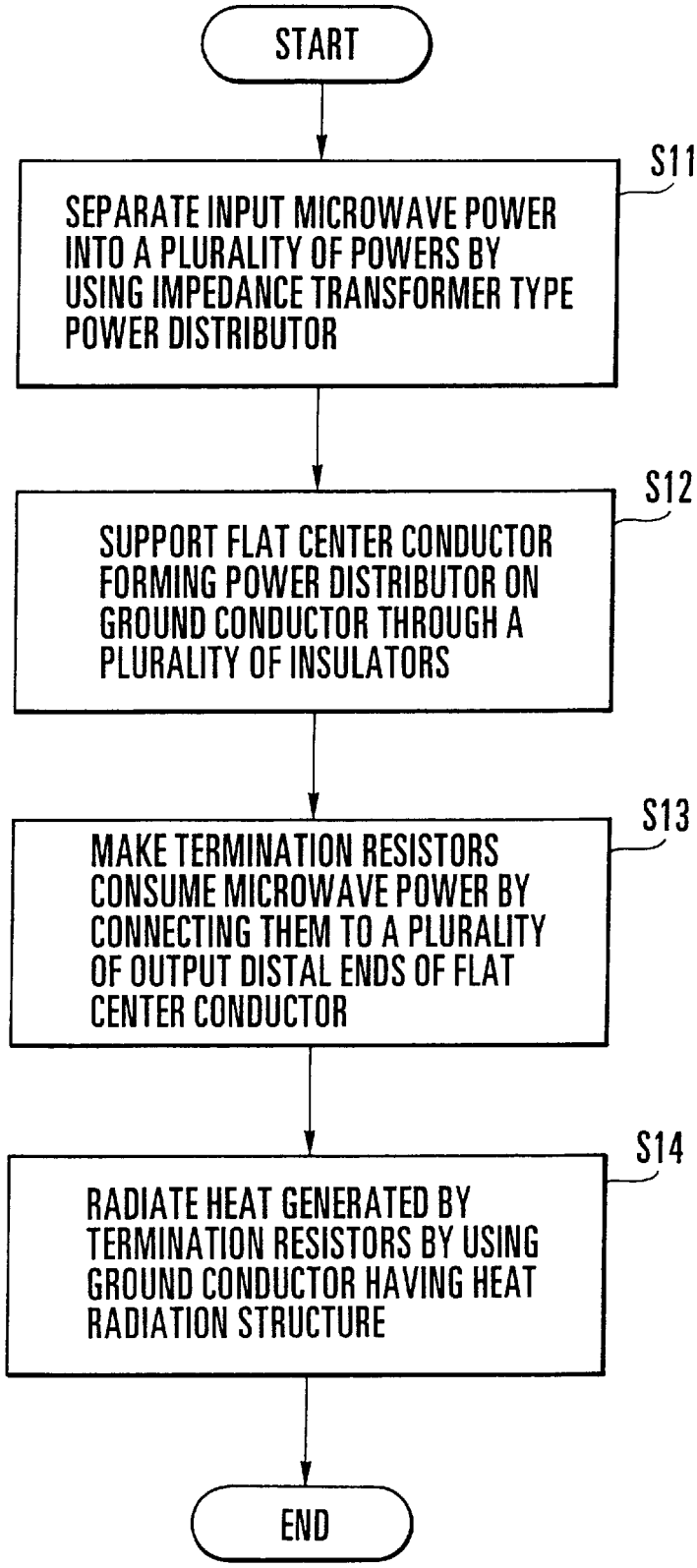
FIG. 3 is a flow chart showing a microwave testing high-power dummy load forming method according to the present invention.
Figure 4A:
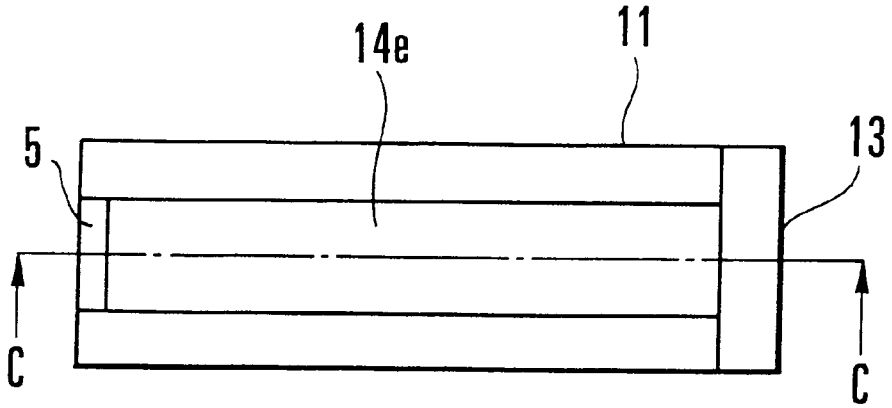
FIG. 4A PRIOR ART
FIG. 4A is a plan view of a conventional microwave testing dummy load.
Figure 4B:
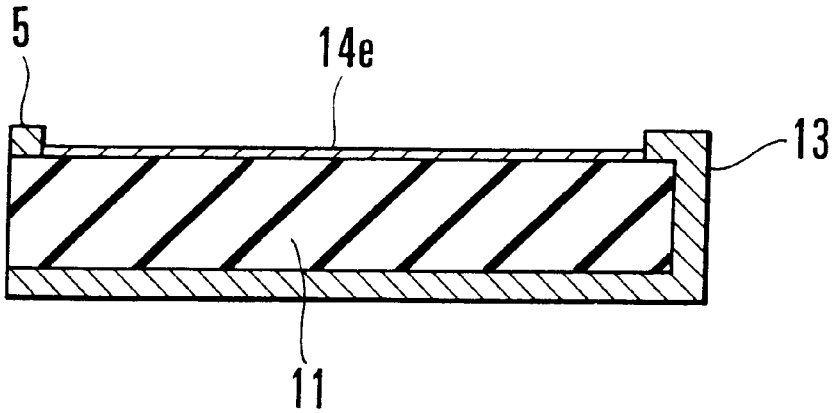
FIG. 4B PRIOR ART
FIG. 4B is a sectional view taken along a line C—C in FIG. 4B.
Figure 5A:
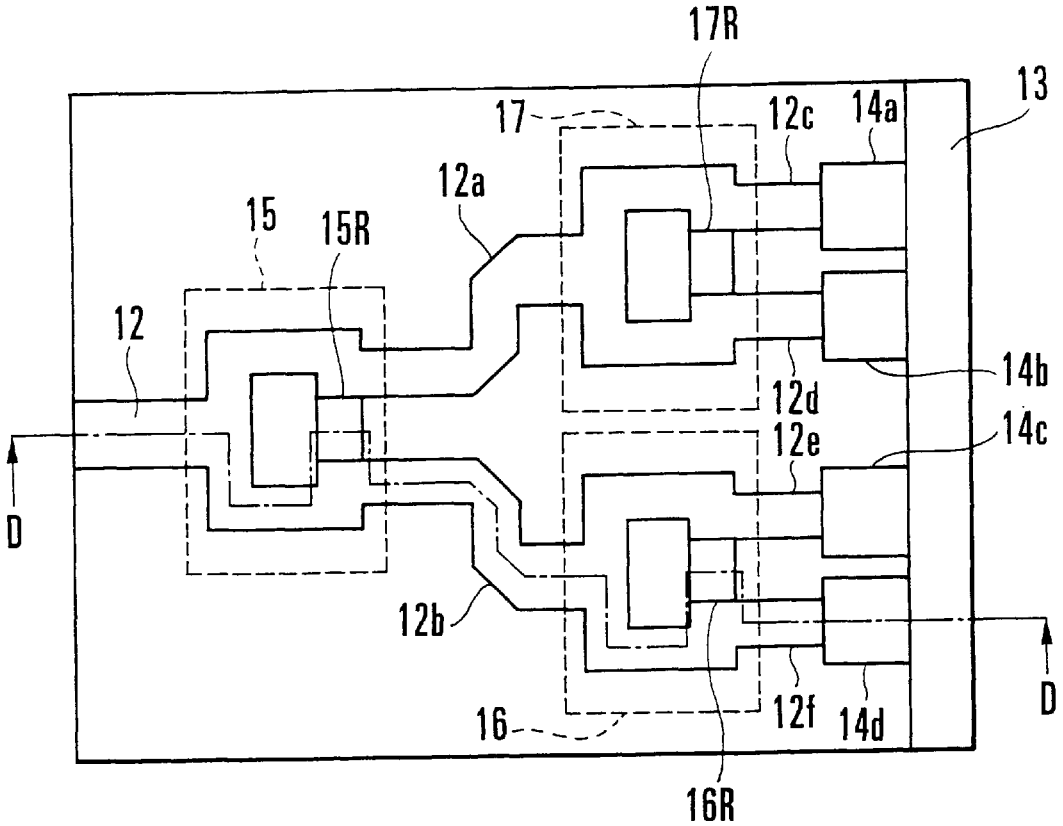
FIG. 5A PRIOR ART
FIG. 5A is a plan view of another conventional microwave testing dummy load.
Figure 5B:
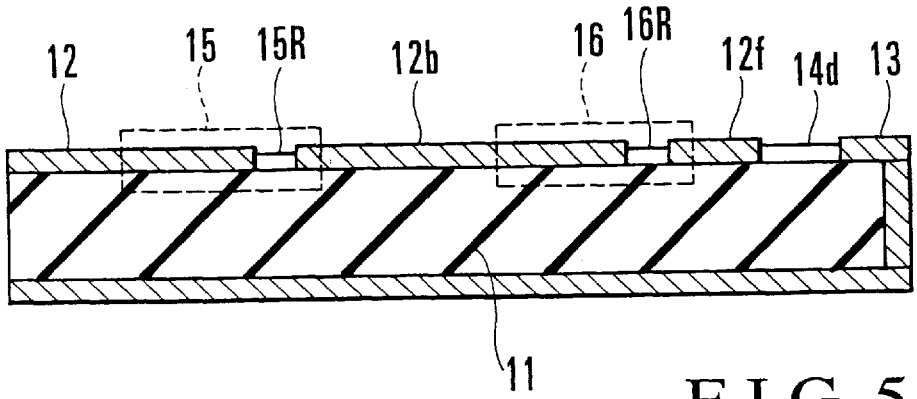
FIG. 5B PRIOR ART
FIG. 5B is a sectional view taken along a line D—D in FIG. 5A.

FIG. 3 is a flow chart showing a method for forming microwave testing high-power dummy load according to the present invention. The high-power dummy load apparatus shown in FIG. 1 is applied to this method.

Referring to FIG. 3, first of all, input microwave power is separated into a plurality of microwave powers by the impedance transformer type power distributor 2 using the flat center conductor 21, and the respective powers are output (step S11).

The flat center conductor 21, forming the power distributor 2, is supported on the ground conductor housing 3 through a plurality of insulators 4 and 8 (step S12).

The termination resistors 1 are connected between the ground conductor housing 3 and the forked distal end portion of the flat center conductor 21 of the power distributor 2 to consume the microwave powers (step S13).

Subsequently, the termination resistors 1 are connected to the ground conductor radiator 32, having the heat radiation structure, to radiate the heat generated upon consumption of the microwave power (step S14).

In the microwave testing dummy load formed by this method, the power consumed by one termination resistor is reduced. Therefore, the overall capacity of the dummy load increases. In addition, the heat generated when power is consumed by the termination resistors 1 is guided to the radiator 32 of the ground conductor housing 3 to be effectively radiated. As a result, a temperature rise caused by each termination resistor 1 can be suppressed, and the capacity per termination resistor 1 can be increased. Therefore, the overall power consumption capacity of the dummy load apparatus increases.

As has been described above, according to the present invention, since the load on each termination resistor can be reduced by separating input microwave power into a plurality of powers through the power distributor, a large-capacity dummy load apparatus can be realized. In addition, since the power distributor is formed by using the flat center conductor, a capacity much larger than that obtained when a center conductor is made of a thin metal film, can be easily obtained.

Furthermore, since an impedance transform type power distributor is used as the above power distributor, an increase in capacity can be attained more effectively. In addition, since the ground conductor serves as a heat radiation plate, the heat generated by the termination resistors can be radiated. This suppresses a temperature rise, leading to an increase in the capacity of the apparatus.

What is claimed is:

1. A method for creating a microwave testing high-power dummy load for testing microwave power said method comprising the acts of:

connecting a first center conductor, which is effective to receive said microwave power, to a power distributor formed from a second center conductor, said second center conductor having an output-side distal end branching into a plurality of output portions, said output portions being designed so as to separate said microwave power into a plurality of outputs corresponding to said plurality of output portions; and connecting a plurality of termination resistors, each between a respective output portion of said second center conductor and a ground conductor radiator so that said termination resistors consume said microwave power, and said ground conductor radiator has a heat radiating structure that radiates heat generated by said termination resistors upon consumption of said microwave power.

2. A method according to claim 1, wherein an impedance transformer type distributor is used as said power distributor.

3. A method according to claim 1, wherein said second center conductor is supported on said ground conductor through a plurality of insulators.

4. A microwave testing high-power dummy load apparatus comprising:

a first center conductor which receives input microwave power;

a power distributor, in the form of a second center conductor, said power distributor being connected to said first center conductor and having an output-side distal end branching into a plurality of output portions, said power distributor separates said input microwave power into a plurality of outputs corresponding to said plurality of output portions; and a plurality of termination resistors each connected between a respective output portion of said second center conductor and a ground conductor radiator, said termination resistors consume said microwave power input to said center conductor; wherein said ground conductor radiator has a heat radiating structure that radiates heat generated by said termination resistors caused by consumption of said microwave power.

5. An apparatus according to claim 4, wherein said power distributor is an impedance transformer type distributor.

6. An apparatus according to claim 4, further comprising a plurality of insulators each having a first end fixed to said ground conductor radiator and a second end supporting said first center conductor.

7. An apparatus according to claim 6, wherein said insulators are made of a ceramic material selected from the group consisting of alumina and beryllia.

8. An apparatus according to claim 4, further comprising:

mount plates on which said termination resistors are mounted;

lead terminals which connect said termination resistors to said second center conductor; and screws which affix said mount plates to said ground conductor radiator.

9. An apparatus according to claim 8, wherein:

said heat radiation structure has a comb-like cross section; and wherein said apparatus further comprises:

a ground conductor upper cover which covers an upper surface of said ground conductor radiator thereby defining a space for housing said second center conductor between said ground conductor upper cover and said ground conductor radiator.

10. A method for testing microwave power using a high-power dummy load said method comprising the acts of:

receiving said microwave power by a first center conductor;

transferring said microwave power from said first center conductor to a power distributor formed by a second center conductor, said second center conductor having an output-side distal end branching into a plurality of output portions, said output portions separating said microwave power into a plurality of outputs corresponding to said plurality of output portions;

transferring said microwave power from said output portions to a plurality of termination resistors, said termination resistors being disposed between said output portions of said second center conductor and a ground conductor radiator so that said termination resistors consume said microwave power; and radiating heat generated by said termination resistors upon consumption of said microwave power through said ground conductor radiator, said ground conductor radiator having a heat radiating structure which radiates said heat.

* * * * *